US005086611A

United States Patent [19]

Purdy

[11] Patent Number: 5,086,611

[45] Date of Patent: Feb. 11, 1992

[54] ANIMAL HALTER

[76] Inventor: Howard A. Purdy, 12777 Quaker St., Lawtons, N.Y. 14091

[21] Appl. No.: 647,174

[22] Filed: Jan. 24, 1991

Related U.S. Application Data

[63] Continuation of Ser. No. 450,444, Dec. 14, 1989, abandoned.

[51] Int. Cl.[5] ..... B68B 1/02

[52] U.S. Cl. ..... 54/24

[58] Field of Search ..... 54/6 R, 6 A, 24

[56] References Cited

U.S. PATENT DOCUMENTS 153,911 8/1874 Reed .
770,663 9/1904 Severns ..... 54/6 R
964,947 7/1910 Varney .
1,325,061 12/1919 Veal ..... 54/24
4,135,348 1/1979 Matthews ..... 54/24
4,852,336 8/1989 Gammill ..... 54/24

*Primary Examiner*—Robert P. Swiatek
*Attorney, Agent, or Firm*—Joseph P. Gastel

[57] ABSTRACT

An animal halter, preferably for a horse, which includes a crown strap, a throat latch selectively fastenable to the crown strap, a pair of cheek straps fastened to the ends of the crown strap, a chin strap fastened to the ends of the cheek straps, and a nose strap having at least one end selectively detachable from at least one end of the cheek strap to thereby permit the cheek straps to fall away from the horse's head while the crown strap and throat latch remain secured around the horse's head at the upper end of the horse's neck.

4 Claims, 1 Drawing Sheet

ANIMAL HALTER

This application is a continuation of application Ser. No. 450,444, filed Dec. 14, 1989, and now abandoned.

BACKGROUND OF THE INVENTION

The present invention relates to an improved halter for an animal, preferably a horse.

By way of background, a halter is normally positioned on a horse for the purpose of controlling it when it is not being ridden. However, when the horse is to be ridden, the halter has to be replaced by a bridle which fits over the horse's head in generally the same manner as the halter. However, in the past the halter had to be removed before the bridle could be placed on the horse's head. This many times resulted in a loss of control of the horse which could move away from the person attending it. It is with overcoming the foregoing problem in an extremely simple and efficient manner that the present invention is concerned.

SUMMARY OF THE INVENTION

It is the primary object of the present invention to provide an improved halter for an animal, preferably a horse, which can be partially detached from the horse's head while the remainder is secured thereto and which will not interfere with the mounting of the bridle on the animal, and which can thereafter be removed without interference from the bridle after the latter has been completely mounted. Other objects and attendant advantages of the present invention will readily be perceived hereafter.

The improved halter of the present invention thus comprises a crown strap having opposite ends, first joining means secured to opposite ends of said crown strap, a throat latch having opposite ends secured to said first joining means, a pair of cheek straps having first and second ends with said first ends secured to said first joining means, second joining means at said second ends of said cheek straps, a chin strap having opposite ends secured to said second joining means, a throat latch strap having opposite ends secured to said first joining means, a nose strap having opposite ends, and means detachably securing at least one of said opposite ends of said nose strap to one of said second joining means.

The improved halter of the present invention essentially functions by making one end of the nose strap of the halter selectively detachable from the common junction of the straps will fall away from the horse's head while the crown strap and the throat latch remain secured around the upper portion of the horse's neck, to thereby permit the horse to be retained under control while the bridle is mounted without interference from the halter, and thereafter the halter can be removed without interference from the bridle by merely unsnapping the throat latch from the crown strap.

The various aspects of the present invention will be more fully understood when the following portions of the specification are read in conjunction with the accompanying drawings wherein:

DESCRIPTION OF THE PREFERRED EMBODIMENTS

Figure 1:
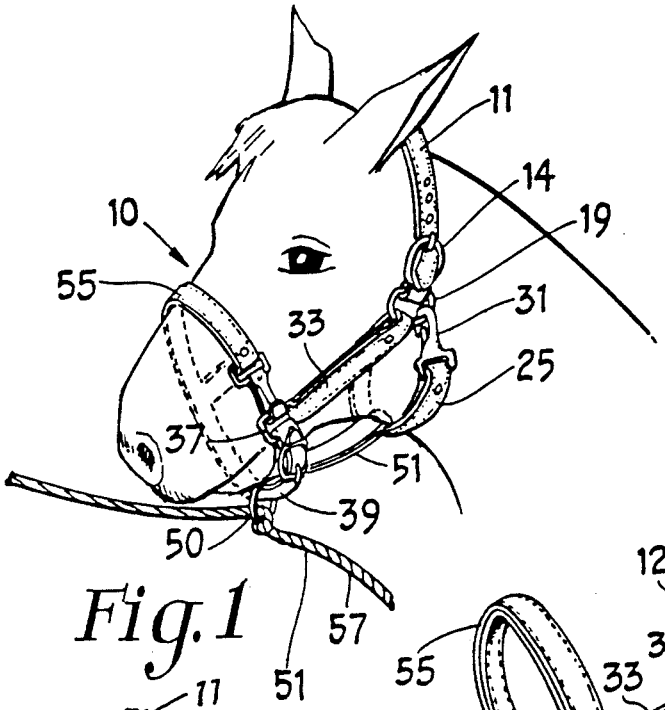
FIG. 1 is a perspective view of the improved halter of the present invention mounted on a horse's head.

The improved halter 10 includes a crown strap 11 which fits over the top of the horse's head behind his ears. A loop 12 is formed at one end of crown strap 11, and it is slidably mounted on metal ring 13. The opposite end of crown strap 11 is fastened by means of buckle 14 to a strap extension 15 which has a loop 17 slidably mounted on ring 19. The buckle bar 20 of buckle 14 is movably mounted within a loop 16 of crown strap extension 15 and the buckle tongue 21 has one end pivotally mounted on buckle bar 20 and its opposite end rests on buckle ring 23 when it extends through one of the adjustment holes 24.

A throat latch strap 25 has an end which is formed into a loop 27 and which is slidably mounted on ring 13. The opposite end of throat latch strap 25 is formed into a loop 29 which receives the end 30 of snap latch 31, the opposite end of which is movably mounted on ring 19 in the conventional manner and is secured thereon by latch spring tongue 32. Thus, the throat latch strap can be selectively detached from ring 19 as required.

A pair of cheek straps 33 have first ends formed into loops 34 which movably encircle rings 13 and 19. The opposite ends of cheek straps 33 are formed into loops 35 which are movably mounted on rings 37.

A chin strap 39 is for placement under the horse's chin. It is an elongated strap having inner portion 40 and outer portion 41 which are not stitched to each other. End 42 of chin strap 39 is formed into a return bend and it receives ring 37. A buckle 43 of the same type as buckle 14 has a central portion 44 suitably secured within a loop 45 at the end of inner strap portion 40. A loop 46 at the extreme end of chin strap portion 40 is mounted on its associated ring 37. The end of outer strap portion 41 has a plurality of holes 47 which are adapted to receive the tongue 49 of buckle 43 to permit the length of chin strap 39 to be adjusted. A loop 49 secures inner portion 40 of the chin strap in alignment with outer portion 41.

A ring 50 is located in encircling relationship to chin strap 39. A vertical connector strap 51 has a loop 52 formed at one end which slidably receives the central portion of throat latch strap 25. The opposite end of vertical connector strap 51 is formed into a loop 53 which receives ring 54 which is looped through ring 50. Thus, connector strap 51 is slidable along the length of throat latch 25 and chin strap 39.

In accordance with the present invention, the nose strap 55 is selectively detachable from one of the rings 37 to enable the chin strap 39 and the cheek straps 33 to fall away from the horse's head while the throat latch strap 25 still remains attached to the crown strap by means of snap fastener 31. Thus, a rope 57, which is knotted about ring 50 (FIG. 1) and which has its opposite ends secured to the sides of a doorway, will retain the horse's head under control while a bridle is mounted thereon. Structurally, the nose strap 55 is formed of two layers of material which are stitched to each other, and it has a loop 59 at one end which slidably receives one of the rings 37. The opposite end of the nose strap is also formed into a loop 60 which slidably receives ring 61 which is the end of snap latch 62 which is snapped onto ring 37, as shown. Thus, when snap latch 62 is opened, the nose strap 55 can be moved away from the horse's nose, as expressed above, and the chin strap 39 and cheek straps 33 will fall away from the horse's head while the crown strap 11 and throat latch 25 remain fastened about the horse's neck. After the bridle has been mounted on the horse, the snap latch 31 is opened and the halter can be removed from the horse's head without interference from the bridle.

Figure 5:
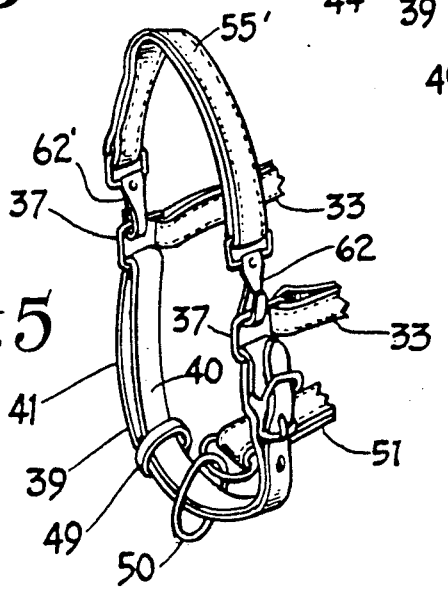
FIG. 5 is a fragmentary perspective view of a modified form of halter.

In FIG. 5 a modified embodiment of the present invention is disclosed. All parts of this embodiment are identical to the previously described embodiment except for the nose strap 55', and thus all identical parts are either not numbered or carry the same numerals. Nose strap 55' differs from nose strap 50 in that in addition to having a snap latch 62 at one end thereof, it also has an additional snap latch 62' at the opposite end thereof rather than the loop 59 of the previous embodiment. Thus, either end of nose strap 55' can be detached from its associated ring 37, whichever is more convenient from the side of the horse at which the handler is located. Also, if desired, the nose strap 55' can be completely removed from the remainder of the halter 10 and can be replaced by another strap, if desired.

Figure 3:
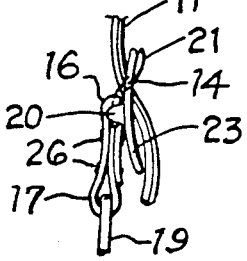
FIG. 3 is a fragmentary side elevational view of the crown strap buckle and associated portions of the crown strap.
Figure 2:
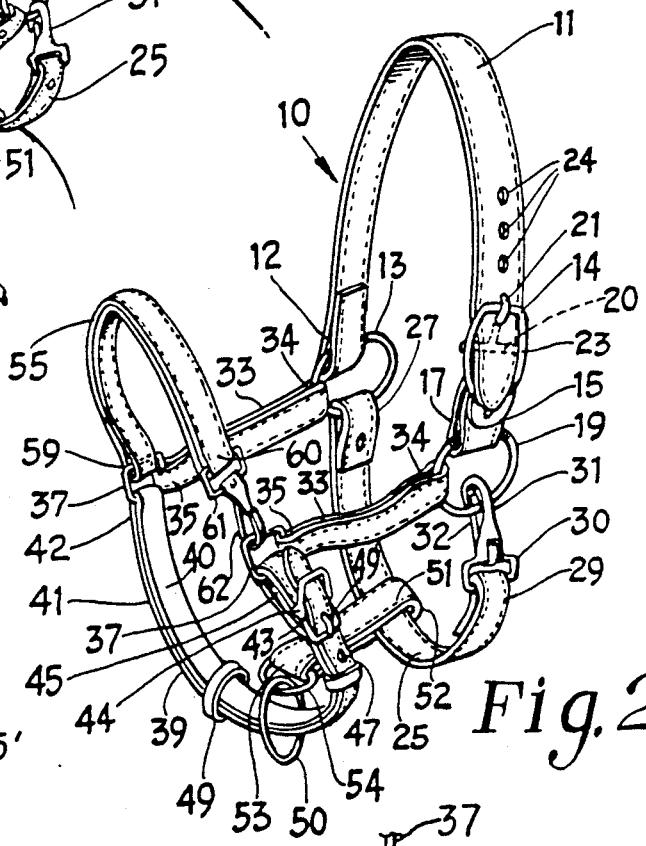
FIG. 2 is an enlarged perspective view of the halter of FIG. 1.
Figure 4:
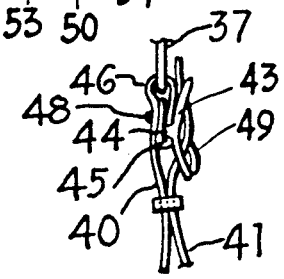
FIG. 4 is a fragmentary side elevational view of the chin strap buckle and associated portions of the chin strap.

The unnumbered dotted lines on the various straps designate stitching which generally holds layers of leather together for both forming the various above described loops and for holding layers of leather together in the major portions of the various straps. Also, at certain of the loops, the layers of leather are also held together by rivets. Two rivets 26 are shown in FIG. 3 and a rivet 48 is shown in FIG. 4.

While the foregoing description has referred to snap latches such as items 62, it will be appreciated that other types of attaching devices may be used.

While the halter has been disclosed in conjunction with a horse, it will be appreciated that it can be used equally well with other types of animals, such as cattle, goat, sheep and the like.

While preferred embodiments of the present invention have been disclosed, it will be appreciated that it is not limited thereto but may be otherwise embodied within the scope of the following claims.

What is claimed is:

1. An animal halter comprising a leather crown strap having opposite ends, first loops at said opposite ends of said leather crown strap, said first loops effectively constituting leather ends of said leather crown strap, first adjustable buckle means on said leather crown strap and spaced from said first loops for adjusting the length of said leather crown strap, first straps mounted within said first loops at said opposite ends of said leather crown strap, a pair of cheek straps having first ends, second loops on said said first ends of said cheek straps mounted on said first rings, second ends on said cheek straps, third loops on said second ends of said cheek straps, second rings mounted in said third loops on said second ends of said cheek straps, a chin strap having first and second opposite ends, a return bend on said first end of said chin strap mounted on one of said second rings, a fourth loop on said second end of said chin strap mounted on the other of said second rings, second adjustable buckle means on said chin strap between said second rings for adjusting the length of said chin strap, a nose strap having first and second opposite ends, means mounting said first and second opposite ends of said nose strap on said second rings including first and second latch means for detachably securing said first and second opposite ends, respectively, of said nose strap to said second rings whereby said first and second opposite ends of said nose strap can substantially move toward and away from said first ends of said cheek straps, a throat latch strap having fifth loops at its opposite ends with one of said fifth loops mounted on one of said first rings, and a snap latch mounted on the other of said fifth loops and having a detachable portion for selective mounting on the other of said first rings.

2. An animal halter as set forth in claim 1 including a vertical connector strap having first and second ends, a sixth loop on said first end of said vertical connector strap slidably receiving a central portion of said throat latch strap, a seventh loop on said second end of said vertical connector strap, a third ring in said seventh loop, and a fourth ring encircling said chin strap and looped within said third ring.

3. An animal halter as set forth in claim 1 wherein said first adjustable buckle means includes a buckle bar, and wherein said leather ends of said leather crown strap comprise one end of said leather crown strap which is turned back on itself and permanently affixed to an adjacent end portion of said leather crown strap to form one of said first loops, and wherein said other end of said crown strap constitutes a loop-shaped leather member having a first loop end portion which receives one of said first rings and a second loop end portion which receives said buckle bar of said first adjustable buckle means, and means for permanently affixing opposite sides of said loop-shaped leather member to each other between said first and second loop end portions to form said loop-shaped leather member into said first and second loop end portions.

4. An animal halter as set forth in claim 1 wherein said second rings have upper portions, and wherein said first and second latch means for securing said first and second ends of said nose strap to both of said second rings comprise first and second nose strap snap latches having first ends fastened to said first and second ends, respectively, of said nose strap and second ends which are freely slidable along the lengths of said upper portions of said rings.

* * * * *

UNITED STATES PATENT AND TRADEMARK OFFICE

CERTIFICATE OF CORRECTION

PATENT NO. : 5,086,611

DATED : February 11, 1992

INVENTOR(S) : Howard A. Purdy

It is certified that error appears in the above-identified patent and that said Letters Patent is hereby corrected as shown below:

Column 1, line 51, before "straps" insert --cheek straps and chin strap of the halter so that the cheek--.

Column 3, line 55 (claim 1), change "straps" to --rings--.

Column 4, line 57 (claim 4), before "rings" insert --second--.

Signed and Sealed this

Eighteenth Day of May, 1993

*Attest:*

Michael K. Kirk

MICHAEL K. KIRK

*Attesting Officer*

*Acting Commissioner of Patents and Trademarks*